US007510051B2

(12) United States Patent
Schrandt

(10) Patent No.: US 7,510,051 B2
(45) Date of Patent: Mar. 31, 2009

(54) SWITCHABLE LOUD AND QUIET EXHAUST APPARATUS

(76) Inventor: Timothy Daniel Schrandt, 6728-52nd Ave., Kenosha, WI (US) 53142

( * ) Notice: Subject to any disclaimer, the term of this patent is extended or adjusted under 35 U.S.C. 154(b) by 334 days.

(21) Appl. No.: 11/433,231

(22) Filed: May 12, 2006

(65) Prior Publication Data

US 2006/0254843 A1 Nov. 16, 2006

Related U.S. Application Data

(60) Provisional application No. 60/680,470, filed on May 12, 2005.

(51) Int. Cl.
*F01N 1/00* (2006.01)
*F01N 1/02* (2006.01)
*F01N 7/18* (2006.01)

(52) U.S. Cl. ..... 181/251; 181/241; 181/254; 180/219

(58) Field of Classification Search ..... 181/251, 181/254, 241; 180/219
See application file for complete search history.

(56) References Cited

U.S. PATENT DOCUMENTS 1,375,621 A * 4/1921 Wright, Jr. ..... 181/236
2,069,751 A * 2/1937 Couch et al. ..... 181/267
2,072,372 A * 3/1937 Riethmiller ..... 181/264
2,492,784 A * 12/1949 Christman ..... 181/236
4,239,091 A * 12/1980 Negrao ..... 181/243
4,699,244 A * 10/1987 Bergquist et al. ..... 181/226
4,703,734 A * 11/1987 Aoyama et al. ..... 123/432
4,841,728 A * 6/1989 Jean et al. ..... 60/312
5,465,756 A * 11/1995 Royalty et al. ..... 137/625.31
5,743,088 A * 4/1998 Grath ..... 60/324
5,881,768 A * 3/1999 Bezos et al. ..... 137/606
5,918,634 A * 7/1999 Hart et al. ..... 137/624.11
5,930,371 A * 7/1999 Cheng et al. ..... 381/71.5
6,000,222 A * 12/1999 Regnier ..... 60/605.2
6,178,744 B1 * 1/2001 Perset ..... 60/288
6,179,313 B1 1/2001 Christensen
6,193,004 B1 2/2001 Cooksey
6,247,305 B1 6/2001 Bassani
6,352,056 B1 * 3/2002 Ruman ..... 123/65 PE
6,408,980 B1 6/2002 Dooley
6,463,641 B2 10/2002 Bassani
6,499,562 B1 * 12/2002 Elfinger et al. ..... 181/251
6,612,400 B2 * 9/2003 Bravo ..... 181/254
6,634,171 B1 * 10/2003 Banks, III ..... 60/313
6,648,099 B2 11/2003 Dooley
6,715,581 B2 4/2004 Dooley
6,732,510 B2 * 5/2004 Ciray ..... 60/312
6,755,279 B2 * 6/2004 Kaneko et al. ..... 181/232
6,804,955 B2 10/2004 Bassani
7,021,052 B1 4/2006 Hicks
7,152,398 B2 12/2006 Bassani
7,222,004 B2 * 5/2007 Anderson ..... 701/22
7,347,045 B2 * 3/2008 Bozmoski et al. ..... 60/312
7,380,638 B2 * 6/2008 Willey ..... 181/254
2005/0092944 A1 * 5/2005 Patterson ..... 251/4
2006/0000205 A1 * 1/2006 Bozmoski et al. ..... 60/324

(Continued)

*Primary Examiner*—Walter Benson
*Assistant Examiner*—Christina Russell
(74) *Attorney, Agent, or Firm*—Lesavich High-Tech Law Group, P.C.; Stephen Lesavich

(57) ABSTRACT

A switchable exhaust system apparatus. The switchable exhaust system apparatus is switchable between a quiet or normal mode and a loud mode when desired.

7 Claims, 3 Drawing Sheets

U.S. PATENT DOCUMENTS

2006/0173593 A1* 8/2006 Anderson ..... 701/36
2007/0246294 A1* 10/2007 Willey ..... 181/254
2007/0256673 A1* 11/2007 Bozmoski et al. ..... 123/568.11
2008/0023264 A1* 1/2008 Pacini et al. ..... 181/237

* cited by examiner

SWITCHABLE LOUD AND QUIET EXHAUST APPARATUS

CROSS REFERENCES TO RELATED APPLICATIONS

The application claims priority to U.S. Provisional Patent Application No. 60/680,470, filed May 12, 2005, the contents of which are incorporated by reference.

FIELD OF THE INVENTION

This invention relates to exhaust systems. More specifically, it relates to a switch able loud and quiet exhaust system apparatus for motorcycles, automobiles, trucks and marine vehicle exhaust systems.

BACKGROUND OF THE INVENTION

There are millions of motorcycle riders in the United States. One of the loudest noises that is produced by a motorcycle is from the exhaust system. Noise levels from motorcycle exhaust systems are measured in Decibels (dB) are regulated by government agencies at all levels not to exceed certain levels.

Generally at least four things influence how loud a motorcycle engine exhaust system will be: (1) a size of the motorcycle engine; (2) a number of pistons used by the motorcycle engine; (3) a construction of an exhaust system including internal and external flow of exhaust gases; and (4) function of motorcycle (e.g., road or street riding, racing, off road, etc.).

In general, high-performance off-road two-cylinder motorcycles tend to be louder than their four-stroke road motorcycles with the same size engine because to squeeze the most power out of a two-cycle engine the exhaust system is tuned to evacuate the cylinder during the exhaust phase of a piston stroke as quickly as possible. In addition, a motorcycle with a big engine with a small number of cylinders (e.g., 1 or 2) is typically louder than a motorcycle with a smaller engine with more cylinders (e.g., 4 cylinder).

Motorcycles produced in factories that have stock exhaust systems are relatively quiet. However, many motorcycle riders desire "loud pipes," or a loud exhaust system to attract attention, because they like the loud sound and for performance reasons. For example, many riders who buy Harley-Davidson motorcycles often replace stock or original exhaust systems with loud pipes.

There are several problems associated with loud exhaust systems on motorcycles. One problem is that motorcycles with loud exhaust systems are preferred by many riders but are a nuisance to others if a rider leaves home early in the morning or comes home late in the evening when others are sleeping.

Another problem is that a maximum noise level allowed by one governmental agency may be prohibited by another governmental agency. Since many motorcycle riders cross into and between areas regulated by different governmental agencies a motorcycle rider may have an exhaust system deemed legal in one governmental area but deemed illegal by another governmental agency.

Another problem is loud exhaust system make it difficult for a motorcycle rider to talk to a passenger or another rider. Another problem is that a loud exhaust system makes it difficult for a rider to listen to a radio, talk on a citizen band radio, cell phone, etc. Another problem is that loud exhaust system typically are higher performance than quiet exhaust systems.

Another problem is that switchable loud and quiet exhaust systems are also desirable on automobiles, trucks and marine vehicles.

Thus, it is desirable to provide an exhaust system that can be easily switched from a loud mode to a quiet mode when necessary.

SUMMARY OF THE INVENTION

In accordance with preferred embodiments of the present invention, some of the problems associated with exhaust systems are overcome. A switchable exhaust system apparatus is presented.

The switchable exhaust system apparatus is switch able between a quiet or normal mode and a loud mode.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF THE INVENTION

Figure 1A:
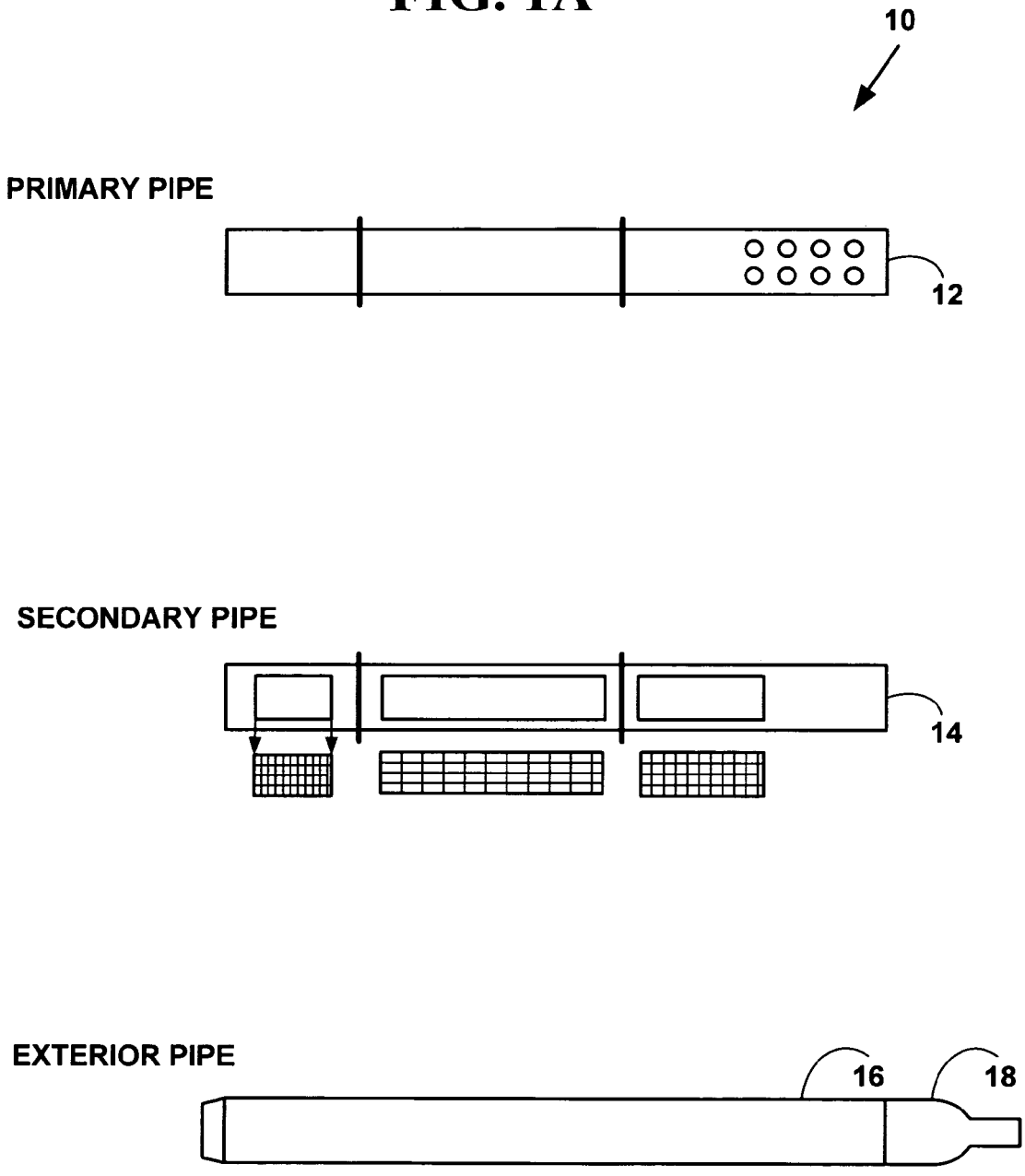
FIGS. 1A and 1B are a block diagram illustrating a switchable exhaust system apparatus.
Figure 1B:
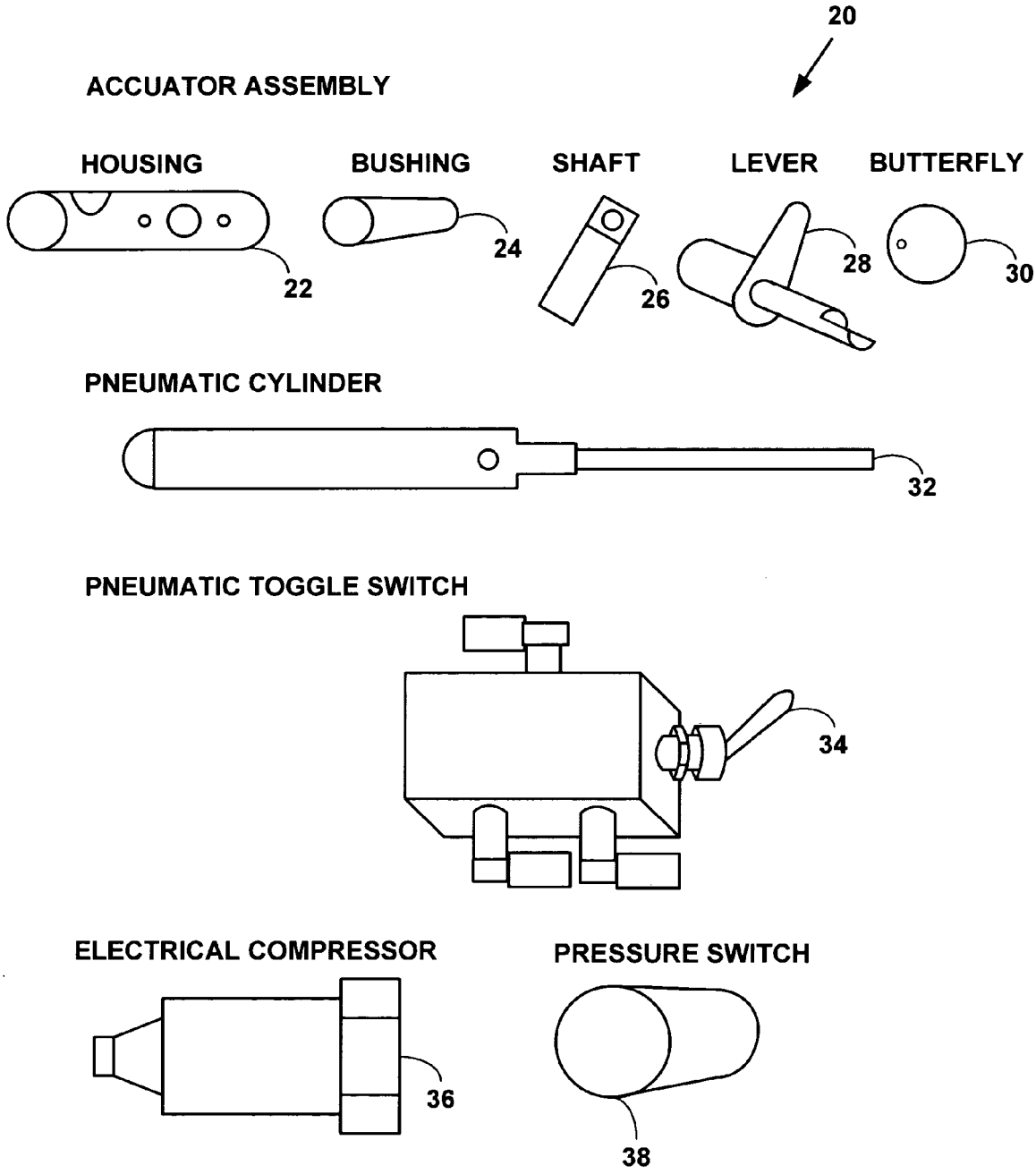

FIGS. 1A and 1B are a block diagram illustrating a switchable exhaust system apparatus 10. FIG. 1A illustrates a primary pipe 12, a secondary pipe 14, a third pipe 16, a nose cone 18 of the switchable exhaust system 10.

FIG. 1B illustrates an actuator assembly 20 with plural parts, including a housing 22, bushing 24, shaft 26, lever 28, butterfly valve 30, two or more pneumatic dual action cylinders 32 (one is illustrated), a pneumatic toggle switch 34, an electrical compressor 36 and a pressure switch 38.

However, the present invention is not limited to these components and more, fewer or other components can also be used to practice the invention. In addition, the components included on FIG. 1 are exemplary only and other components can also be used to practice the invention.

In one embodiment, in FIG. 1A the primary pipe 12 receives exhaust gases from an exhaust system at first end and includes plural holes around the first end. The primary pipe 12 also includes a second end to discharge exhaust gases. Exhaust gases from the exhaust system are forced out though the plural holes at the first or the second end of the primary pipe depending on the position of the butterfly valve 30 in the actuator assembly 20. The primary pipe 12 includes spacers to allow space between it and another pipe.

The secondary pipe 14 includes a first end for receiving exhaust gases and a second end from discharging exhaust gases. The secondary pipe 14 includes plural removed portions and covered with plural screens and is connected to an exhaust system at one end. The primary pipe 12 is placed inside the secondary pipe 14. Exhaust gases from the plural holes from the primary pipe 12 are forced out the plural portions covered with the plural screens from the secondary pipe 14 or the second end or the secondary pipe depending on the position of the butterfly valve 30. The primary pipe 12 includes spacers to allow space between it and another pipe.

The third pipe 16 placed over the secondary pipe 14. The third pipe 16 includes a first end for receiving exhaust gases and a second end from discharging exhaust gases. The actuator assembly 20 is connected outside and through a second end of the third pipe 16, second pipe 14 and first pipe 12. A nose cone 18 is placed over a first end of the third pipe 16 to connect to an exhaust system.

In FIG. 1B the actuator assembly 20 includes the butterfly valve 30, the two or more pneumatic dual action cylinders 32, the pneumatic toggle switch 34 to supply exhaust to the two or more pneumatic dual action cylinders 32 to open or close the butterfly valve 30. The electrical compressor 36 supplies pressure to the pneumatic toggle switch 34, and the pressure switch 38 maintains a constant air pressure (e.g., 60 pounds per square inch (PSI), etc.) to the electrical compressor 36. The exhaust system apparatus is switchable via the actuator assembly between a loud mode and a quiet mode. The switchable motorcycle exhaust system apparatus 10 is switchable between a quiet mode and a loud mode.

In one embodiment the switchable exhaust system 10 is used for an automobile, truck, motorcycle or marine vehicle exhaust system. However, the present invention is not limited to these embodiments and other embodiments can also be used to practice the invention.

In one embodiment, the switchable exhaust system 10 is operated in one or the other of two modes by a 12 volt direct current (DC) electrical compressor 36 and the two or more pneumatic dual action cylinders 32 by flipping the pneumatic toggle switch 34 between two possible positions. When the pneumatic toggle switch 32 is in a first position air is forced down into the two more pneumatic dual action cylinders 32, and a butterfly valve 30 in the actuator assembly 20 to be closed. Closing the butterfly valve 30 in the actuator assembly 20 causes exhaust to be redirected to the bottom and ends of the pipes 12, 14, 16 and the second ends to discharge exhaust gases in a quiet mode.

Figure 2:
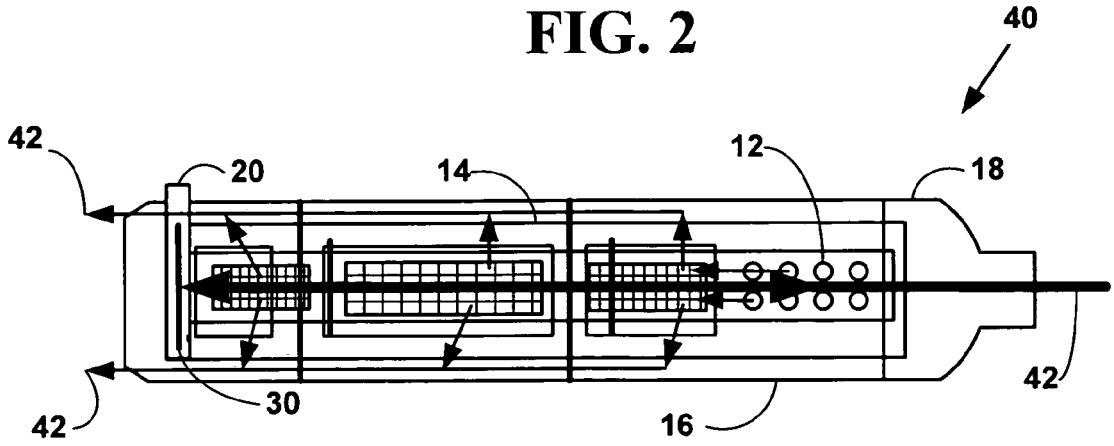
FIG. 2 is a block diagram illustrating an exhaust flow pattern in the switchable motorcycle exhaust system apparatus in a quiet (closed) mode.

FIG. 2 is a block diagram 40 illustrating an exhaust flow pattern 42 in the switchable motorcycle exhaust system apparatus 10 in a closed mode. In the closed mode, the butterfly valve 30 is closed in the actuator assembly 20. The closed mode is the quiet mode. Exhaust gases are forced down and out of the plural holes of the first end of the primary pipe 12. The exhaust gases are forced into the secondary pipe 14 from the primary pipe 12. The exhaust gases are forced down and out of the plural screened portions of the secondary pipe 14 into the third pipe 16. The exhaust gases are discharged out of the second end of the third pipe 16. However, the present invention is not limited to this flow pattern and other flow patterns using other components can also be used to practice with invention.

Figure 3:
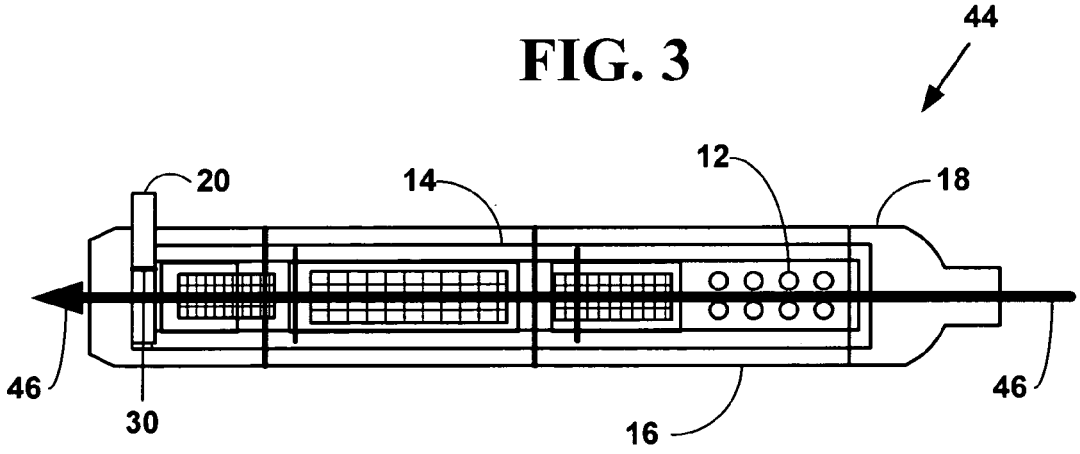
FIG. 3 is a block diagram illustrating an exhaust flow pattern in the switchable motorcycle exhaust system apparatus in a loud (open) mode.

FIG. 3 is a block diagram 44 illustrating an exhaust flow pattern 46 in the switchable motorcycle exhaust system apparatus 10 in an open mode. The open mode is the loud mode. When switchable motorcycle exhaust system apparatus 10 is in the open mode, the butterfly valve 30 is open and exhaust is forced directly out the second ends of the pipes 12, 14, 16.

The switch able exhaust system apparatus 10 is switchable between a quiet or normal mode and a loud mode.

The switchable exhaust system apparatus described herein is switchable between a quiet or normal mode and a loud mode for motorcycles, automobiles, trucks and marine vehicle exhaust systems.

In view of the wide variety of embodiments to which the principles of the invention can be applied, it should be understood that the illustrated embodiments are exemplary only, and should not be taken as limiting the scope of the invention. For example, more or fewer elements may be used in the block diagrams.

While various elements of the preferred embodiments have been described as being implemented in with specific, in other embodiments other more, fewer or equivalent components can be used to practice the invention.

The claims should not be read as limited to the described order or elements unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

I claim:

1. A switchable exhaust system apparatus, comprising in combination:

a primary pipe with a first end to receive exhaust gases from exhaust system and a second end to discharge the exhaust gases with a plurality of holes around the first end, wherein exhaust gases from the exhaust system are forced out though the plurality of holes around the first end or directly out of the second end depending on a position of a butterfly valve in an actuator assembly within the primary pipe;

a secondary pipe with a first end to received exhaust gases and a second end to discharge exhaust gases, wherein a plurality of portions are removed from the secondary pipe and covered with a plurality of screens, wherein the primary pipe is placed inside the secondary pipe and wherein exhaust gases from the plurality of holes from the primary pipe are forced out of the primary pipe and out of the of the plurality of sections covered with the plurality of screens in the secondary pipe or at the second end of the secondary pipe depending on the position of the butterfly valve;

a third pipe with a first end to received exhaust gases and a second end to discharge exhaust gases placed over the secondary pipe, wherein portions of the actuator assembly are connected outside and through the first end of the third pipe, second pipe and first pipe and a nose cone placed over the second end of the third pipe to connect to the exhaust system; and the actuator assembly including two more pneumatic dual action cylinders, a pneumatic toggle switch to supply pressure to the two or more pneumatic dual action cylinders to open or close the butterfly valve, an electrical compressor to supply pressure to the pneumatic toggle switch, and a pressure switch for maintaining a constant air pressure to the electrical compressor, wherein the exhaust system apparatus is switchable via the actuator assembly between a loud mode and a quiet mode via the pneumatic toggle switch.

2. The switchable exhaust system apparatus of claim 1 wherein the exhaust system includes an automobile, truck, motorcycle or marine vehicle exhaust system.

3. The switchable exhaust system apparatus of claim 1 wherein the quiet mode includes closing the butterfly valve in the actuator assembly and wherein exhaust gases are forced out of the plurality of holes of the primary pipe into the secondary pipe, forced out of the plurality of screens in the secondary pipe into the third pipe and are discharged out of the second end of the third pipe.

4. The switchable exhaust system apparatus of claim 1 wherein the loud mode includes opening the butterfly valve in the actuator assembly and wherein exhaust gases are forced directly through the first end of first pipe and second pipe and are discharged out of the first end of third pipe.

5. A switchable motorcycle exhaust system apparatus, comprising in combination:

a primary pipe with a first end to receive exhaust gases from a motorcycle exhaust system and a second end to discharge the exhaust gases with a plurality of holes around the first end, wherein exhaust gases from the motorcycle exhaust system are forced out though the plurality of holes around the first end or directly out of the second end depending on a position of a butterfly valve in an actuator assembly within the primary pipe;

a secondary pipe with a first end to received exhaust gases and a second end to discharge exhaust gases, wherein a plurality of portions are removed from the secondary pipe and covered with a plurality of screens, wherein the primary pipe is placed inside the secondary pipe and wherein exhaust gases from the plurality of holes from the primary pipe are forced out of the primary pipe and out of the of the plurality of sections covered with the plurality of screens in the secondary pipe or at the second end of the secondary pipe depending on the position of the butterfly valve;

a third pipe with a first end to received exhaust gases and a second end to discharge exhaust gases placed over the secondary pipe, wherein portions of the actuator assembly are connected outside and through the first end of the third pipe, second pipe and first pipe and a nose cone placed over the second end of the third pipe to connect to the motorcycle exhaust system; and the actuator assembly including two more pneumatic dual action cylinders, a pneumatic toggle switch to supply pressure to the two or more pneumatic dual action cylinders to open or close the butterfly valve, an electrical compressor to supply pressure to the pneumatic toggle switch, and a pressure switch for maintaining a constant air pressure to the electrical compressor, wherein the exhaust system apparatus is switchable via the actuator assembly between a loud mode and a quiet mode via the pneumatic toggle switch.

6. A switchable exhaust apparatus, comprising in combination, an exhaust means including a primary pipe with a first end to receive exhaust gases from exhaust system and a second end to discharge the exhaust gases with a plurality of holes around the first end, wherein exhaust gases from the exhaust system are forced out though the plurality of holes around the first end or directly out of the second end depending on a position of a butterfly valve in an actuator assembly within the primary pipe, a secondary pipe with a first end to received exhaust gases and a second end to discharge exhaust gases, wherein a plurality of portions are removed from the secondary pipe and covered with a plurality of screens, wherein the primary pipe is placed inside the secondary pipe and wherein exhaust gases from the plurality of holes from the primary pipe are forced out of the primary pipe and out of the of the plurality of sections covered with the plurality of screens in the secondary pipe or at the second end of the secondary pipe depending on the position of the butterfly valve, a third pipe with a first end to received exhaust gases and a second end to discharge exhaust gases placed over the secondary pipe, wherein portions of the actuator assembly are connected outside and through the first end of the third pipe, second pipe and first pipe and a nose cone placed over the second end of the third pipe to connect to the exhaust system; and a switching means including the actuator assembly including two more pneumatic dual action cylinders, a pneumatic toggle switch to supply pressure to the two or more pneumatic dual action cylinders to open or close the butterfly valve an electrical compressor to supply pressure to the pneumatic toggle switch, and a pressure switch for maintaining a constant air pressure to the electrical compressor, wherein the exhaust system apparatus is switchable via the actuator assembly between a loud mode and a quiet mode via the pneumatic toggle s witch.

7. The switchable exhaust apparatus of claim 6 wherein the exhaust systems includes an automobile, truck, motorcycle or marine vehicle exhaust system.

* * * * *